United States Patent [19]

Skelton

[11] Patent Number: 4,570,285

[45] Date of Patent: Feb. 18, 1986

[54] WIRE ROPE CLEANING DEVICES

[76] Inventor: Alan W. Skelton, 103 Shaftesbury Way, Twickenham, Middlesex TW2 5RW, England

[21] Appl. No.: 559,924

[22] Filed: Dec. 9, 1983

[30] Foreign Application Priority Data

Dec. 10, 1982 [GB] United Kingdom ..... 8235318

[51] Int. Cl.[4] ..... D02J 7/00

[52] U.S. Cl. ..... 15/256.6; 15/104.04; 15/160; 15/236 R

[58] Field of Search ..... 15/104.04, 256.5, 256.6, 15/160, 40, 88; 134/9; 118/DIG. 11, 72; 184/15.1, 16, 17

[56] References Cited

U.S. PATENT DOCUMENTS 2,285,742 6/1942 Miller ..... 15/256.6 X
3,999,240 12/1976 Uchida ..... 15/256.6
4,422,208 12/1983 Rohrbaugh ..... 15/256.6

FOREIGN PATENT DOCUMENTS 2396443 3/1979 France ..... 15/88
858832 1/1961 United Kingdom ..... 15/256.6
1361417 7/1974 United Kingdom ..... 15/256.6

*Primary Examiner*—Edward L. Roberts
*Attorney, Agent, or Firm*—Howard L. Rose

[57] ABSTRACT

A wire rope cleaning device consists of a number of split collars that are clamped closed on the rope and are equipped with equiangularly-spaced arrays of tools, in the form of brushes and picks or spikes, directed radially inward to contact the rope surfaces. The tools are adjustable radially in the collars to suit different sizes of rope and may be locked in the radial positions to which they are adjusted or spring-loaded. The collars bear endwise against one another and against a frame which is anchored by chains so that the wire rope can be winched through the collars. If a first collar has spikes engaging in the helical grooves of a rope the collar will rotate as the rope is pulled through and a second collar equipped with brushes can also be caused to rotate by being clutched to the first collar. Scraper plates to scrape the rope surfaces are clamped to the ends of the collars.

14 Claims, 5 Drawing Figures

WIRE ROPE CLEANING DEVICES

This invention relates to a device for cleaning wire ropes or cables.

Lubricators for wire ropes or cables exist that are able to apply grease lubricant under pressure to a wire rope while it is running in a service environment. This is satisfactory for new clean ropes; but if the rope has been in service for a long period it will probably be contaminated with rust, mud, old lubricant, and so forth. Applying fresh grease under pressure to the rope will then be less effective, and it might even in some cases do more harm than good by forcing surface contaminants into the strands of the rope.

The present invention overcomes this problem by providing a wire rope cleaning device that can clean a wire rope or cable while it is running in a service environment.

According to the invention, a wire rope or cable cleaning device comprises an anchoring frame through which the rope can pass centrally, and one or more split collars which can be closed around the rope and which carry inwardly directed tools for cleaning the rope as it passes through the collars, the collars and the anchoring frame being assembled in end-to-end abutting assembly so that by anchoring the frame by means of chains or the like the whole assembly can be held against the pull of the rope as it runs through. Collars with various tools to operate on the rope in any chosen sequence can be assembled within the anchoring frame, and since there are no restraining connections between the collars and the anchoring frame the components of the assembly can shift relatively to one another to accommodate flexing of the rope. Also, one or more of the collars can rotate to follow the helical stranding of the running rope surface.

Figure 1:
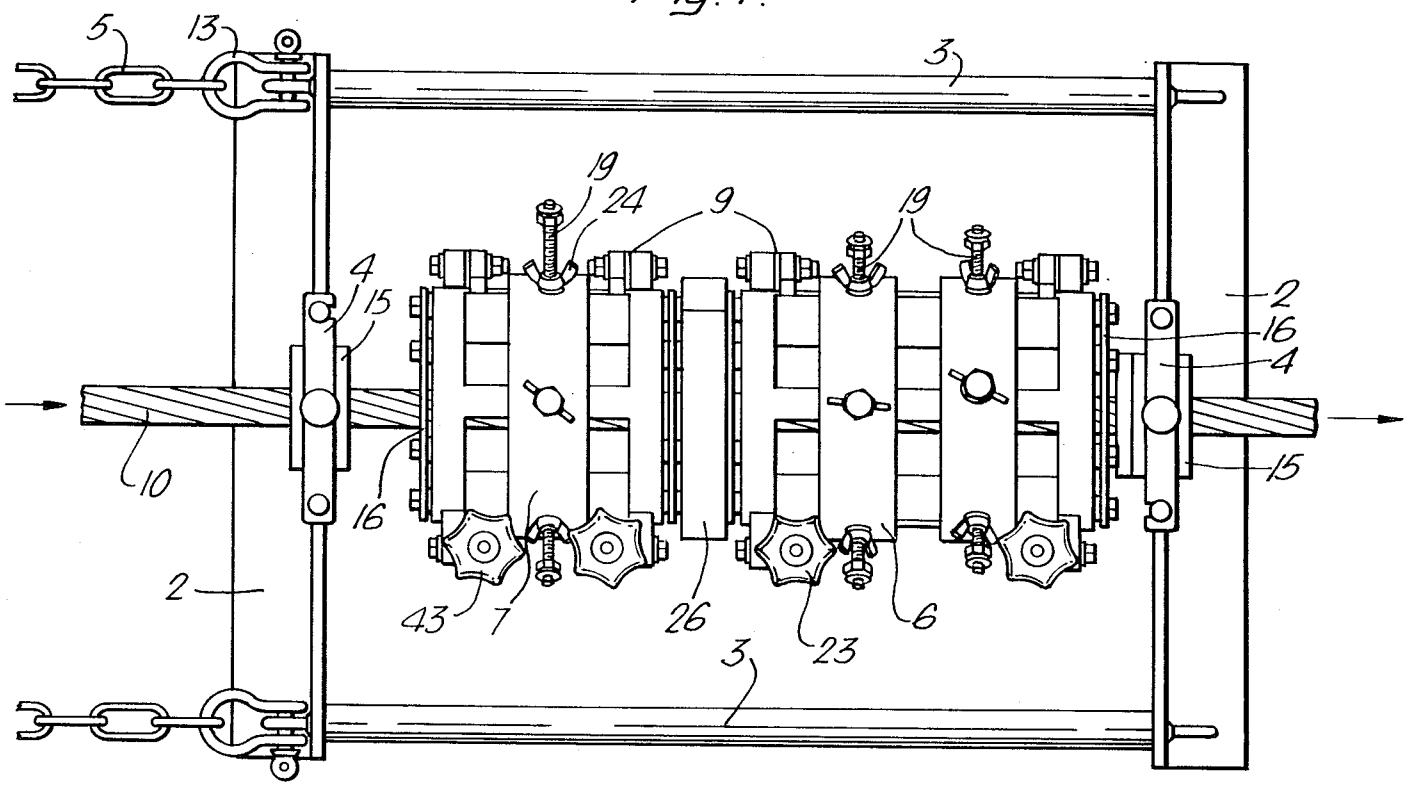
Figure 2:
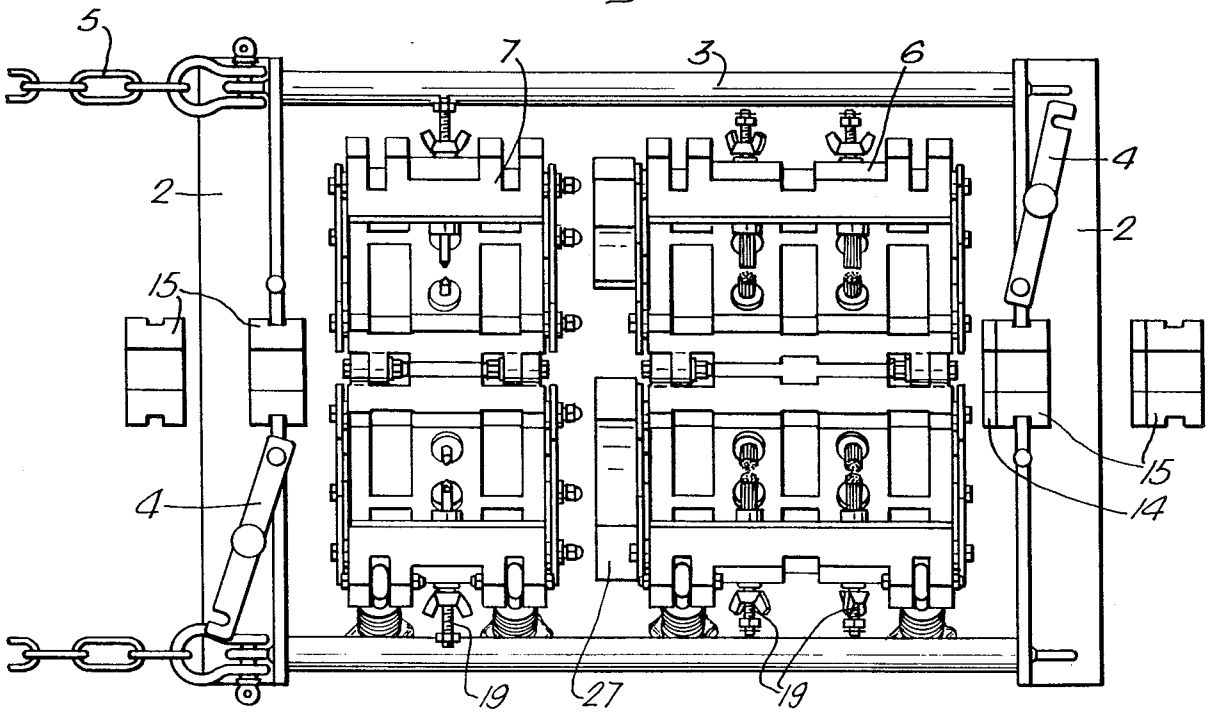
Figure 3:
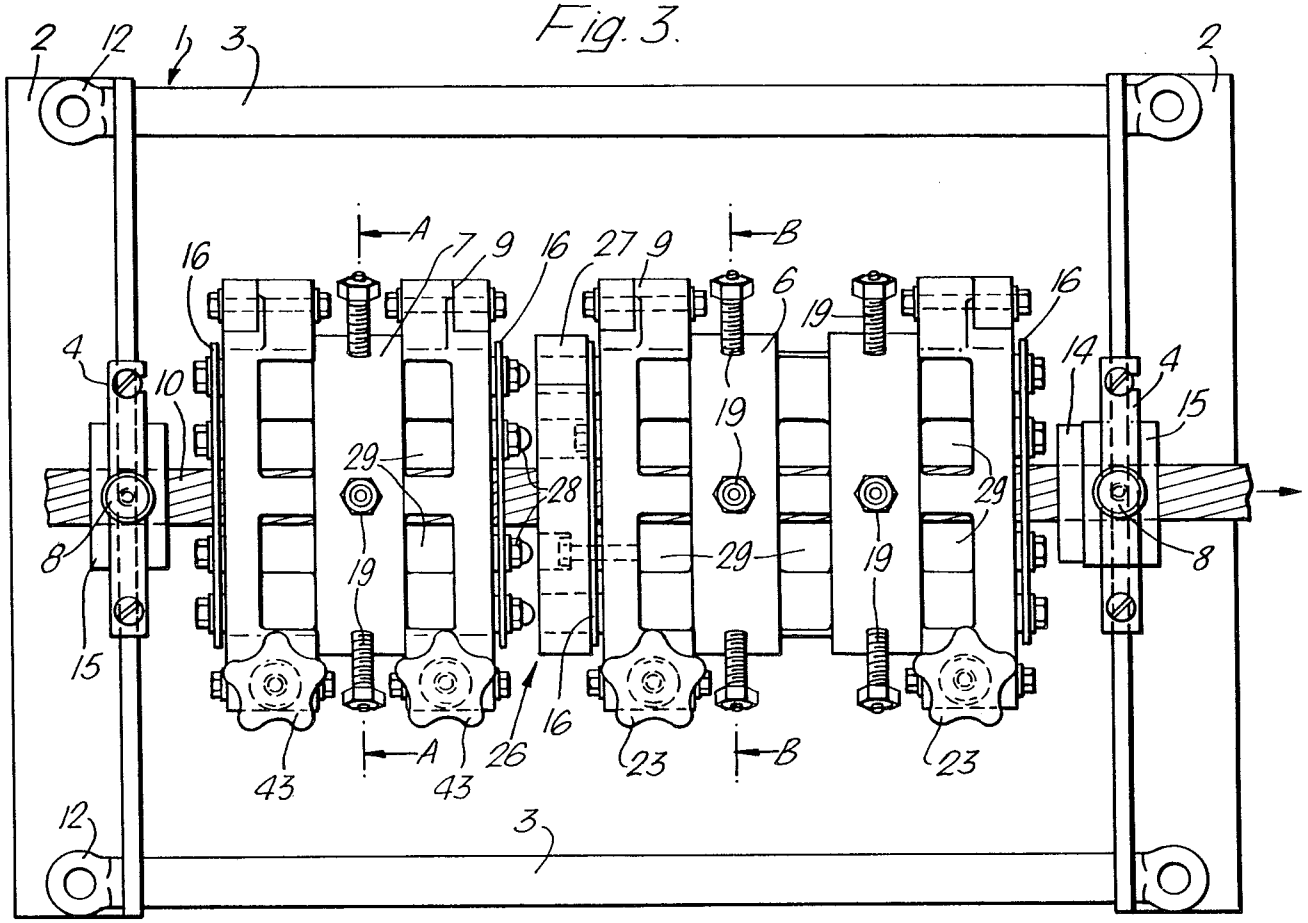
Figure 4:
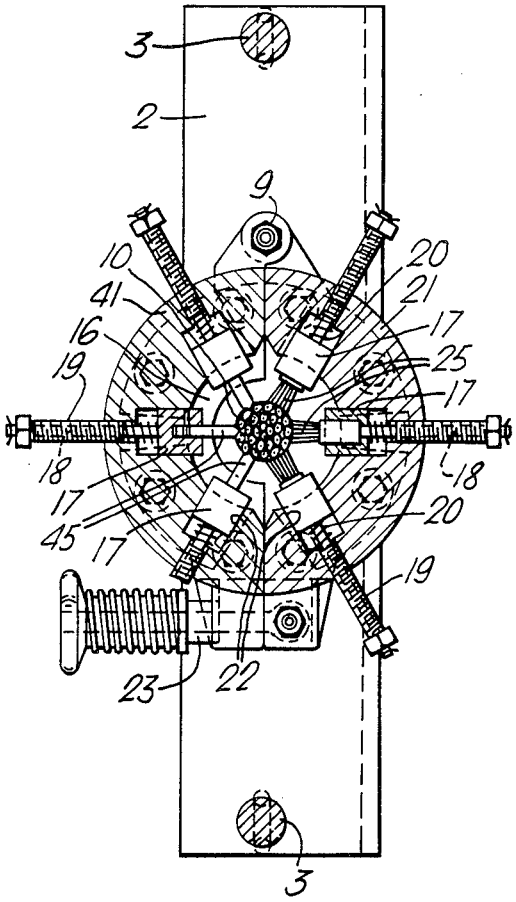
Figure 5:
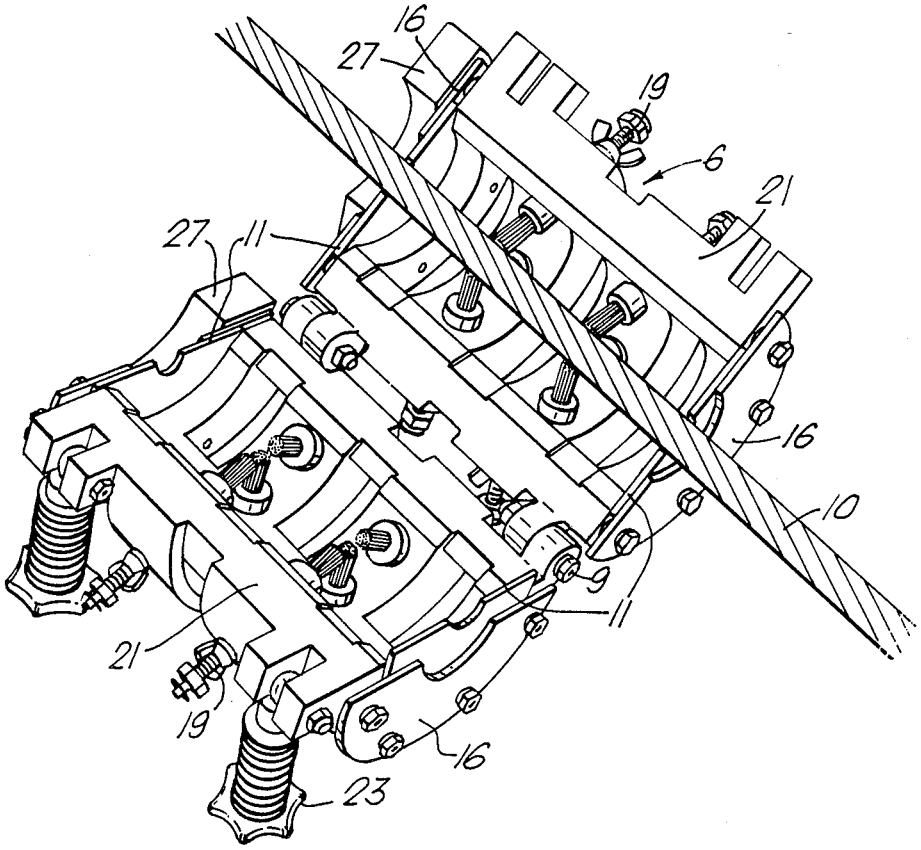

One arrangement embodying the invention will now be described in more detail, by way of example, with reference to the accompanying drawings, in which:

FIG. 1 is an outside elevation of the wire rope cleaning device to be described, FIG. 2 is a corresponding view but with the split tool-bearing collars and wire guides open to show their interiors, FIG. 3 is a further diagrammatic elevation, FIG. 4 is an end view with the left hand and right hand halves in section on the lines A—A and B—B of FIG. 3, respectively, and FIG. 5 is a perspective view of a tool-bearing collar in the open condition.

The arrangement to be described is capable of cleaning the surface of various forms of wire rope, from 10 to 40 mm in diameter, at high speed, in situ in the working environment.

The device has a steel anchor frame 1 which is basically two anglesection spaced cross bars 2 rigidly connected by longitudinal rods 3, each with a central hole in which split wireguides 15 are fitted and through which the wire rope 10 passes. The two halves of each wireguide 15 are secured when closed around the rope by a clamping bar 4 and a screw 8. The wireguides 15 are interchangeable to suit different rope diameters. Diametrically-opposed eyelets 12 are provided on each cross bar 2 for the attachment of anchor chains 5 by means of shackles 13. On the inside of the forward wireguide 15, there is fixed a split Tufnol (Registered Trade Mark) bush 14 to act as a thrust bearing.

Inside the anchor frame 1 in FIG. 3, two tool-bearing collars 6, 7 are shown spaced out of engagement with one another and the anchor frame, for the sake of clarity. The two halves 21, 41 of each split collar 6 or 7, which may be aluminium castings, are hinged together at 9 and secured when closed around the rope by pairs of clamping screws 23, 43. On each side of each collar 6 or 7 there are positioned split stainless steel scraper plates 11 (FIG. 5), in recesses behind bolted steel end discs 16. These scraper plates 11 are interchangeable to suit different wire rope diameters.

Each of the collars 6, 7 has an internal diameter considerably greater than that of the wire rope 10 which passes through it. The tools or brushes for cleaning the rope project inwardly toward the rope from the internal surface of the collar at positions spaced equiangularly around the collar. Each tool or brush is disposed in a spring-loaded tool holder 17 and has a shank 18 that passes radially through the collar and is adjustable radially to suit different rope diameters. The tool holders 17 are slidable radially in internal recesses 22 in the collars 6, 7. The collar 6 forward in the anchor frame 1 carries twelve wire brushes 25 arranged in two arrays of six, equiangularly spaced. The further collar 7 carries one array of six equiangularly located spikes 45, which may be of hardened tool steel with either needle or chisel tips. The spikes 45 are free to rotate in their holders 17. The shanks 18 of the tools pass through hollow externally-projecting adjustor bolts 19 that are fitted into threaded radial holes in the collars and against the inner ends of which the loading springs 20 for the tool holders bear. Thus screwing in or out of the adjustors 19 changes the radial positions of the tools, except that each tool can retract to the extent permitted by its spring 20. Each adjustor 19 has a locking wing nut 24.

The spiked tools 45 of the collar 7 are groove-combing spikes that engage in the helical grooves along the surface of the rope 10. Consequently, the collar 7 rotates as the rope runs through. The collar 6 bearing the wire brushes 25 also rotates, being coupled to the collar 7 by a drive clutch 26. The clutch consists of two recessed blocks 27 bolted to the face of one end disc 16 of the collar 6 and having recesses to receive dogs on the adjacent end disc of the collar 7, which dogs are, in fact, dome-headed bolts 28 holding the end disc 16 in assembly with the collar 7. The collar 6 rotates in contact with the nonrotating thrust bearing face provided by the Tufnol bush 14 on the anchor frame forward wireguide 15.

When the device is in use, the wire rope 10 is winched through the device at normal rope-operating speeds in the direction from left to right in FIGS. 1 and 3 as indicated by the arrows. The whole assembly is restrained against the pull of the rope as it runs through by the anchor chains 5 attached to the frame 1. The wire brushes 25 are adjusted radially to positions in which they maintain firm contact with the wire rope surface, and the groove-combing spikes 45 are likewise adjusted radially inward until they locate in the helical rope grooves, and the adjustors 19 are then locked. However, limited retraction movement of each tool is made possible by the coil springs 20 fitted around the tool shanks 18.

The assembly as described will clean the helical grooves of a six-strand rope. For ropes with a greater number of grooves, the spikes 45 in the collar 7 can be replaced by spiked brushes of stiff spring wire, the many wires of which engage in the shallower multiple grooves and so provide the combined groove cleaning and rotation of the collar. Whereas in the arrangement illustrated both the brushes and the spikes are spring-loaded, it may in certain cases be advantageous to have one kind of tool spring-loaded and the other kind locked against radial movement. For example, the spikes can be spring-loaded and the brushes fixed.

The spikes 45 dig out debris from the grooves of the rope, the brushes 25 remove surface contaminants from the wire strands, and the scraper plates 11 scrape the rope surface clean. In addition, the rotation of the collars 6, 7 helps to remove the loosened debris by centrifugal action. Each collar 6, 8 has debris outlets 29, arranged in three rings in the case of the collar 6, and two rings in the case of the collar 7. However, the wire brushes 25, without the groove-digging spikes 45, may be sufficient in some cases and it is not always essential that they should rotate. Also, in the case of a static wire rope, cleaning can still be carried out by winching the device along the rope using the anchor frame 1 as a pulling frame.

Further modifications of the arrangement described are, of course, possible without departing from the scope of the invention. Thus, whereas each split collar 6 or 7 is described as comprising a pair of castings, the collars could instead be built up from a series of parts clamped in axial succession by through bolts.

I claim:

1. A wire rope or cable cleaning device, wherein said rope is stranded with helical grooves between said strands, comprising:

an anchoring frame having a first end through which a rope can pass into said frame and having a second end through which a rope passes out of said frame, at least one split collar positioned within said frame, means for closing said collar around a rope, said collar forming a sleeve around a rope and having a rope receiving end and a rope discharge end, said discharge end of said collar abutting the interior surface of said second end of said frame, means for mounting inwardly directed tools having a rope engaging surface and allowing independent rotatation of said tools within said collar about an axis perpendicular to a rope, and means for anchoring the frame against the pull of a rope as it passes through said collar.

2. A device according to claim 1, wherein there are at least two collars equipped with different kinds of cleaning tools.

3. A device according to claim 2, wherein one collar is equipped with cleaning brushes and another collar with spikes, wherein said brushes and said spikes engage the helical grooves of a rope.

4. A device according to claim 1 or claim 2 or claim 3, wherein the tools are arranged in equiangularly spaced arrays around the collar axes.

5. A device according to claim 3 wherein the collar equipped with spikes has a single equiangularly-spaced array of spikes, and the collar equipped with brushes has two axially-spaced arrays of brushes.

6. A device according to claim 1 or claim 2 or claim 3 or claim 5, wherein the tools are radially adjustable in the collars.

7. A device according to claim 1 or claim 2 or claim 3 or claim 5, wherein at least some of the tools are spring-loaded radially inward.

8. A device according to claim 3, wherein the brushes are fixed in the radial positions to which they are adjusted and the spikes are spring-loaded.

9. A device according to claim 1 or claim 2 or claim 3 or claim 5, wherein each collar has attached to its ends, means for scraping a rope as it passes through.

10. A device according to claim 3 or claim 5 wherein the collar equipped with the spikes rotates as the rope is pulled through.

11. A device according to claim 10, wherein the collar equipped with brushes is clutched to the collar equipped with spikes and also rotates.

12. A device according to claim 1 or claim 2 or claim 3 or claim 5, wherein each collar has openings for escape of debris from a rope.

13. A device according to claim 1 or claim 2 or claim 3 or claim 5, wherein the anchoring frame comprises two spaced cross-bars rigidly connected by longitudinal rods, one cross-bar having a bearing face against which the collars, disposed between the cross-bars, thrust while the other cross-bar has apertures to receive means for anchoring the frame at any point along the length of a rope.

14. A device according to claim 13, wherein each cross-bar has a central hole in which is clamped a wire-guide through which the rope passes.

* * * * *